United States Patent [19]

Harada et al.

[11] 4,148,283

[45] Apr. 10, 1979

[54] ROTATIONAL SPEED DETECTING APPARATUS FOR ELECTRONICALLY-CONTROLLED FUEL INJECTION SYSTEMS

[75] Inventors: Susumu Harada, Oobu; Kunio Endo, Anjo, both of Japan

[73] Assignee: Nippondenso Co., Ltd., Kariya, Japan

[21] Appl. No.: 812,598

[22] Filed: Jul. 1, 1977

[30] Foreign Application Priority Data

Jul. 19, 1976 [JP] Japan ..... 51-86412
Nov. 17, 1976 [JP] Japan ..... 51-138711

[51] Int. Cl.[2] ..... F02B 3/00

[52] U.S. Cl. ..... 123/32 EG; 123/32 EH; 123/32 EJ; 123/32 EL

[58] Field of Search ..... 123/32 EA, 32 EG, 32 EH, 123/32 EL, 32 EJ, 179 L

[56] References Cited

U.S. PATENT DOCUMENTS

| | | | |
|---|---|---|---|
| 3,683,869 | 8/1972 | Kamazuka et al. | 123/32 EH |
| 3,747,575 | 7/1973 | Eisele et al. | 123/32 EA |
| 3,749,065 | 7/1973 | Rothfusz et al. | 123/32 EH |

*Primary Examiner*—Charles J. Myhre
*Assistant Examiner*—Tony M. Argenbright
*Attorney, Agent, or Firm*—Cushman, Darby & Cushman

[57] ABSTRACT

A rotational speed detecting apparatus for controlling the operation of an electronically controlled fuel injection system in accordance with the rotational speed of an engine. A reference pulse generator is connected to generate a reference pulse signal in synchronism with a pulse signal which is generated by the fuel injection system in substantial synchronism with the rotation of the engine. The reference pulse generator is further connected to change the time width of the reference pulse signal in response to the operation of a starter motor and a throttle valve so that it represents the predetermined rotational speeds of the engine. A comparison circuit is connected to compare the one cycle period of the pulse signal with the time width of the reference pulse signal. The output signal of the comparison circuit is applied to the fuel injection system so that it controls fuel enrichment and fuel cut-off operation of the fuel injection system.

4 Claims, 6 Drawing Figures

ROTATIONAL SPEED DETECTING APPARATUS FOR ELECTRONICALLY-CONTROLLED FUEL INJECTION SYSTEMS

BACKGROUND OF THE INVENTION

The present invention relates to a rotational speed detecting apparatus for electronically-controlled fuel injection systems which detects the rotational speed of an engine in accordance with engine operating parameters other than the actual engine rotational speed.

In the past, there have been electronically-controlled fuel injection systems for supplying fuel to internal combustion engines, in which the supply of fuel is cut off during the periods of deceleration of the engine, and the fuel is enriched during the periods of starting, high load operation and the like. While these fuel cut-off and fuel enrichment have the advantage of ensuring accurate fuel supply to the engine, both of these operations are effected in relation to the engine rotational speed, thus requiring very complicated means for detecting the engine rotational speed. In other words, it is necessary to provide a rotational speed detector for discriminating the rotational speed ranges and a plurality of comparators each comparing the detected rotational speed with a preset value. This results in an increase in the number of elements used, thus increasing the cost of the apparatus and deteriorating its reliability.

SUMMARY OF THE INVENTION

It is an object of this invention to provide a rotational speed detecting apparatus for detecting the rotational speed of an internal combustion engine in accordance with a pulse signal generated from an electronically controlled fuel injection system and signals indicative of the operating conditions of a starter motor and a throttle valve.

It is another object of the invention to provide a rotational speed detecting apparatus for detecting the rotational speed of an internal combustion engine by comparing a pulse signal generated from an electronically-controlled fuel injection system with a reference pulse signal corresponding to the operating conditions of a starter motor and a throttle valve.

DESCRIPTION OF THE PREFERRED EMBODIMENTS

The present invention will now be described in greater detail with reference to the illustrated embodiments.

Figure 1:
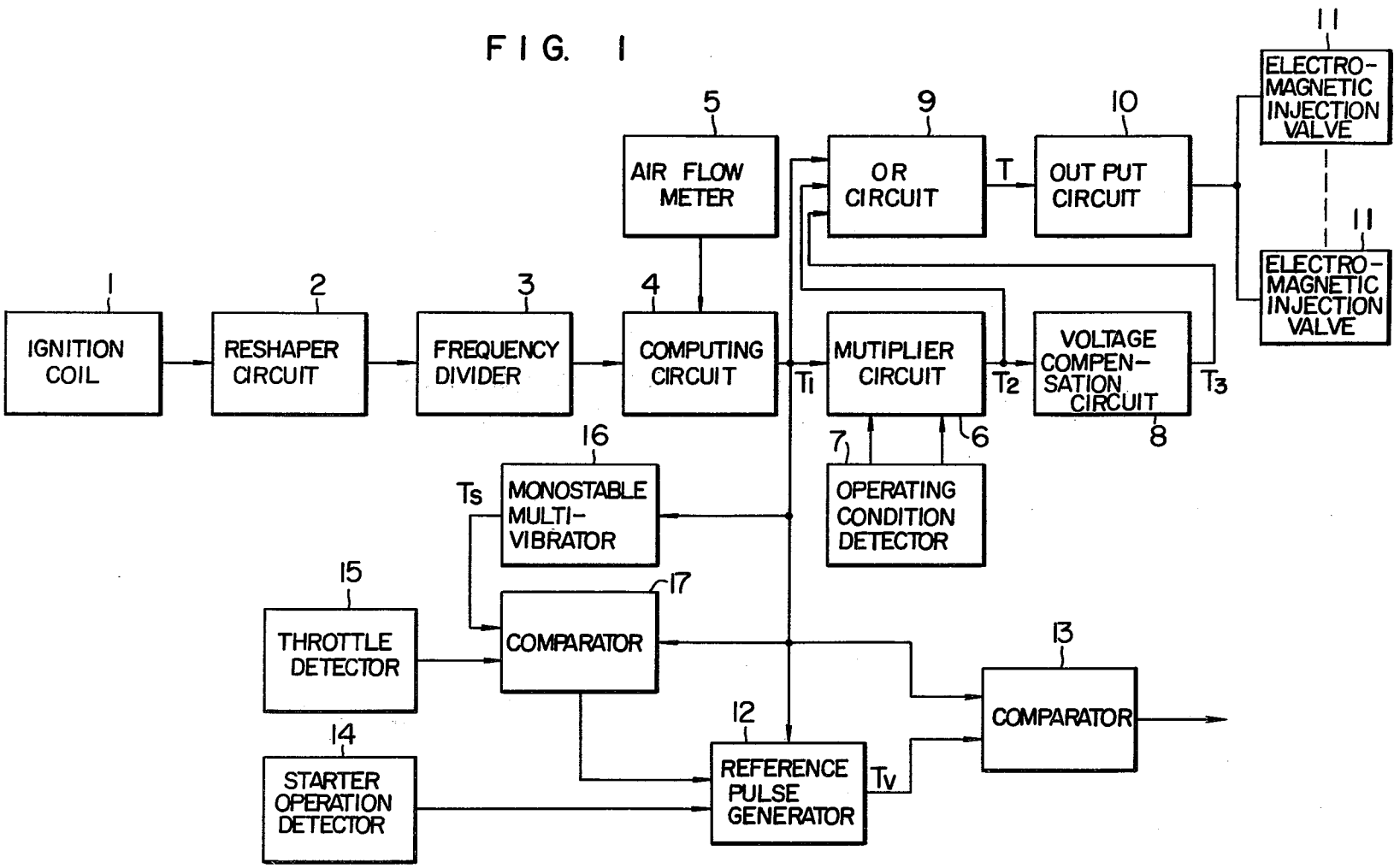
FIG. 1 is a block diagram showing the general construction of a first embodiment of the invention.

Referring to FIG. 1 showing a first embodiment of the invention, numeral 1 designates an ignition coil for generating, in the form of a voltage waveform, an ignition signal at an interval inversely proportional to the rotational speed of an engine (not shown), 2 a reshaper circuit for reshaping the voltage waveform for preventing the occurrence of erroneous operation, 3 a frequency divider adapted for operating electromagnetic injection valves 11 once for every revolution of the engine. The frequency divider 3 will be a ½ frequency divider in the case of a four-cylinder engine, and it will be a ⅓ frequency divider in the case of a six-cylinder engine. Numeral 4 designates a computing circuit for receiving a signal from an air flow meter 5 which is indicative of the amount of intake air to divide the amount of air drawn into the engine by the engine rotational speed, namely, it generates a pulse signal $T_1$ of a pulse time width $t_1$ which is proportional to the amount of air drawn into each cylinder during each stroke at a period inversely proportional to the engine rotational speed. Numeral 6 designates a multiplier circuit for increasing or multiplying the pulse time width $t_1$ of the pulse signal $T_1$ generated from the computing circuit 4 by various signals from an operating condition detector 7 adapted to detect the engine cooling water temperature, intake air temperature, etc., to generate a pulse signal $T_2$ of a pulse time width $t_2$. Numeral 8 designates a voltage compensation circuit for receiving the pulse signal $T_2$ from the multiplier circuit 6 to generate a voltage compensation pulse signal $T_3$ of a time width $t_3$ to compensate for changes in the fuel injection quantity from the electromagnetic injection valves 11 caused by the applied voltage. Numeral 9 designates an OR circuit for receiving the pulse signals $T_1$, $T_2$ and $T_3$ from the computing circuit 4, the multiplier circuit 6 and the voltage compensation circuit 8 to supply to an output circuit 10 a pulse signal T having a time width $(t_1+t_2+t_3)$, thus opening the electromagnetic injection valves 11 for the time width $(t_1+t_2+t_3)$ of the pulse signal T and thereby supplying to the engine an optimum amount of fuel that suits the operating conditions of the engine. The above-described construction and operation are the same with those of the conventional electronically-controlled fuel injection systems, and the injection of fuel is effected in synchronism with the rotation of the engine or at a period inversely proportional to the engine rotational speed.

Numeral 12 designates a reference pulse generator employing a retriggerable monostable multivibrator, and numeral 13 designates a comparator for comparing the one cycle period of the pulse signal $T_1$ generated from the computing circuit 4 and synchronized with the engine rotation with the time width $t_v$ of a pulse signal $T_v$ generated from the reference pulse generator 12 and synchronized with the pulse signal $T_1$. The time width $t_v$ of the pulse signal $T_v$ from the reference pulse generator 12 is variable in accordance with input signals, and connected to the reference pulse generator 12 is a starter operation detector 14 for detecting the starting condition of the engine. Numeral 16 designates a monostable multivibrator for generating a pulse signal $T_5$ of a constant time width $t_5$ in synchronism with the pulse signal $T_1$ from the computing circuit 4, and numeral 17 designates a comparator for comparing the time width $t_s$ of the pulse signal $T_s$ from the monostable multivibrator 16 with the time width $t_1$ of the pulse signal $T_1$ from the computing circuit 4, and connected to the comparator 17 is a throttle detector 15 for detecting the opening of the throttle valve. The output signal of the comparator 17 is applied to the reference pulse generator 12 to vary the time width $t_v$ of the pulse signal $T_v$ generated from the reference pulse generator 12. The purpose of this construction is to indirectly detect the rotational speed of the engine from the engine operating conditions.

Figure 2:
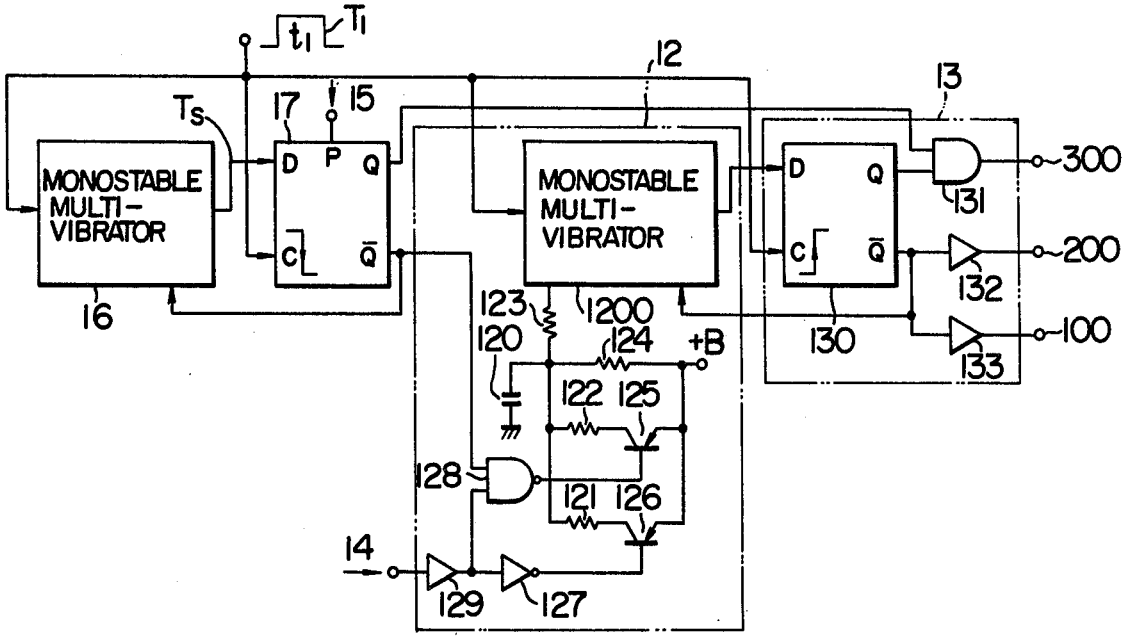
FIG. 2 is a wiring diagram showing a detailed construction of the principal parts of FIG. 1.

As shown in FIG. 2, the comparator 17 comprises a known type of D-type flip-flop adapted to be triggered by the trailing edge of the pulse signal $T_1$ and it is so connected that a high level signal is applied to its preset terminal P when the opening of the throttle valve is smaller than a preset opening. The reference pulse generator 12 comprises a monostable multivibrator 1200, a capacitor 120, resistors 121, 122, 123 and 124, transistors 125 and 126, an inverter 127, a NAND gate 128 and a buffer gate 129, and it is designed so that a low level signal is applied to the buffer gate 129 from the starter operation detector 14 when the starter motor is in operation or the engine starting switch is in its closed position. The comparator 13 comprises a D-type flip-flop 130 adapted to be triggered by the rising edge of the pulse signal $T_1$, an AND gate 131 and buffer gates 132 and 133.

With the construction shown in FIG. 2, the operation of the first embodiment will now be described with reference to FIG. 3.

During the starting period of the engine with the starter motor being in operation, a "0" signal (a low level signal) is applied to the reference pulse generator 12 from the starter operation detector 14, so that the inverter 127 generates a "1" signal (a high level signal) thus turning the transistor 126 off, and the NAND gate 128 also generates a "1" signal thus also turning the transistor 125 off. Consequently, no current flows in the resistors 121 and 122, and thus the monostable multivibrator 1200 is operated with the time constant determined by the resistors 123 and 124 and the capacitor 120. As a result, the monostable multivibrator 1200 generates a pulse signal $T_v$ of a time width $t_{v1}$ as shown in (C) of FIG. 3 in synchronism with the pulse signal $T_1$ of the time width $t_1$ shown in (A) of FIG. 3. The voltage developed across the capacitor 120 at this time is shown by the characteristic curve $b_1$ in (B) of FIG. 3, and the time width $t_{v1}$ is dependent on the characteristic curve $b_1$. The time width $t_{v1}$ of the pulse signal $T_v$ is preset to correspond to a first preset engine rotational speed, namely, if the one cycle period of the pulse signal $T_1$ is 150 ms when the engine speed is at the first preset rotational speed of 400 rpm (the rotational speed used as a basis for determining the necessity of fuel enrichment during engine starting), it also is set to 150 ms.

When the starter motor is not in operation, the starter operation detector 14 applies a "1" signal to the reference pulse generator 12, so that the inverter 127 generates a "0" signal and the transistor 126 is turned on, thus causing a flow of current in the resistor 121. The monostable multivibrator 16 generates a pulse signal $T_s$ of the constant time width $t_s$ in synchronism with the pulse signal $T_1$, and the pulse signals $T_s$ and $T_1$ are respectively applied to the data terminal D and clock terminal C of the D-type flip-flop of the comparator 17. Thus, when the time width $t_1$ of the pulse signal $T_1$ is smaller than the time width $t_s$ of the pulse signal $T_s$, the Q output and $\overline{Q}$ output of the D-type flip-flop respectively go to "1" and "0". On the other hand, when the D-type flip-flop receives at its preset terminal P a "1" signal from the throttle detector 15 which indicates that the throttle valve opening is smaller than a preset opening (e.g., 5°), the Q output and $\overline{Q}$ output respectively go to "1" and "0" irrespective of the input signal at the data terminal D. When the "0" signal from the $\overline{Q}$ output of the D-type flip-flop and the "1" signal from the buffer gate 129 are applied to the NAND gate 128, the NAND gate 128 generates a "1" signal so that the transistor 125 is turned off and no current flows in the resistor 122. Consequently, the monostable multivibrator 1200 comes into operation with the time constant determined by the capacitor 120 and the resistors 121, 123 and 124, thus generating a pulse signal $T_v$ of a constant time width $t_{v2}$ as shown in (C) of FIG. 3 in synchronism with the pulse signal $T_1$ shown in (A) of FIG. 3. The voltage developed across the capacitor 120 at this time is indicated by the characteristic curve $b_2$ in (B) of FIG. 3, and the time width $t_{v2}$ is dependent on the characteristic curve $b_2$. The time width $t_{v2}$ of the pulse signal $T_v$ is preset to correspond to a second preset rotational speed of the engine, namely, if the one cycle period of the pulse signal $T_1$ is 37.5 ms when the engine speed is at the second preset rotational speed of 1600 rpm (the rotational speed used as a basis for determining the necessity of fuel cut-off during deceleration of the engine), the time $t_{v2}$ also is set to 37.5 ms.

Figure 3:
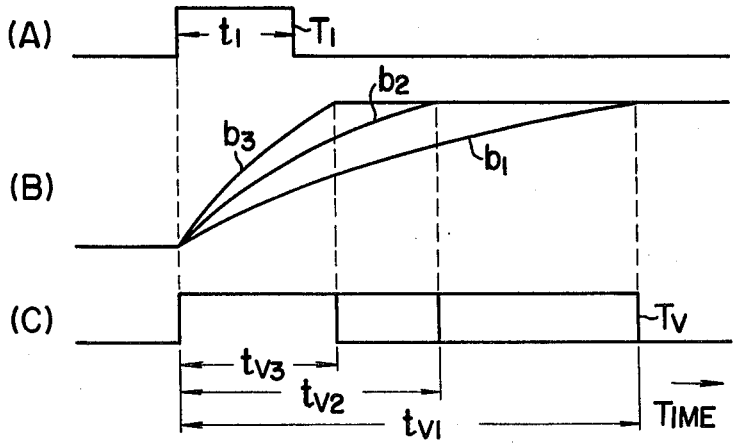
FIG. 3 is a waveform diagram showing the signal waveforms generated at various points in FIG. 2, which are useful for explaining the operation of the first embodiment.

Next, when the starter motor is not in operation and also the D-type flip-flop of the comparator 17 generates a "1" signal from its Q output, both of the transistors 125 and 126 are turned on, and the monostable multivibrator 1200 comes into operation with the time constant determined by the capacitor 120 and the resistors 121, 122, 123 and 124, thus causing the voltage across the capacitor 120 to vary as shown by the characteristic curve $b_3$ in (B) of FIG. 3. Consequently, the monostable multivibrator 1200 generates, in synchronism with the pulse signal $T_1$ shown in (A) of FIG. 3, the pulse signal $T_v$ shown in (C) of FIG. 3 and having a constant time width $t_{v3}$. This time width $t_{v3}$ is preset to correspond to a third preset engine rotational speed, namely, if the one cycle period of the pulse signal $T_1$ is 15 ms when the engine speed is at the third preset rotational speed of 4000 rpm (the rotational speed used as a basis for determining the necessity of fuel enrichment during high load engine operation), the time width $t_{v3}$ also is set to 15 ms.

In other words, the time width $t_v$ of the reference pulse signal $T_v$ generated from the reference pulse generator 12 in response to its input signals representing the throttle valve opening and the operating condition of the starter motor, becomes the time width $t_{v1}$ corresponding to the first preset rotational speed 400 rpm when the starter motor is in operation, becomes the time width $t_{v2}$ corresponding to the second preset rotational speed 1600 rpm when the throttle valve opening is smaller than the preset value or the time width $t_1$ of the pulse signal $T_1$ is smaller than the preset value $t_s$ of the monostable multivibrator 16, and becomes the time width $t_{v3}$ corresponding to the third preset rotational speed 4000 rpm when the throttle valve opening is greater than the preset value or the time width $t_1$ of the pulse signal $T_1$ is greater than the preset value $t_s$.

In the comparator 13, the D-type flip-flop 130 compares the one cycle period of the pulse signal $T_1$ applied to the clock terminal C from the computing circuit 4 with the time width $t_v$ of the pulse signal $T_v$ applied to the data terminal D from the reference pulse generator 12, so that "1" and "0" signals are respectively generated from the Q and $\overline{Q}$ outputs when the one cycle period of the pulse signal $T_1$ is smaller than the time width $t_v$, whereas the opposite signals are generated when the reverse is the case. Since the one cycle period of the pulse signal $T_1$ from the computing circuit 4 is inversely proportional to the engine rotational speed as is well known in the art, when the engine rotational speed is higher than the preset rotational speed represented by the reference pulse signal $T_v$, "1" and "0" signals are respectively generated at the Q and Q outputs of the D-type flip-flop 130. Consequently, a "1" signal is generated at a terminal 100 when the engine rotational speed is lower than the first preset rotational speed (400 rpm), and a "0" signal is generated at the terminal 100 when the engine rotational speed is higher than the first preset rotational speed. On the other hand, a "1" signal is generated at a terminal 300 through the AND gate 131 only when the engine rotational speed is higher than the second preset rotational speed (1600 rpm) and the throttle valve opening is smaller than the preset value. Also, a "1" signal is generated at a terminal 200 when the engine rotational speed is lower than the third preset rotational speed (4000 rpm), while a "0" signal is generated at the terminal 200 when the engine rotational speed is higher than the third preset rotational speed.

Thus, the rotational speed of the engine can be directly detected in accordance with the level of the signal generated at the terminal 100, 200 or 300. For instance, the OR circuit 9 of the electronically-controlled fuel injection system of FIG. 1 can be controlled by the signal generated at the terminal 300 so as to cut off the supply of fuel during deceleration of the engine, and also it is possible to accomplish fuel enrichment in response to the signal generated at the terminal 100 and 300, respectively.

Figure 4:
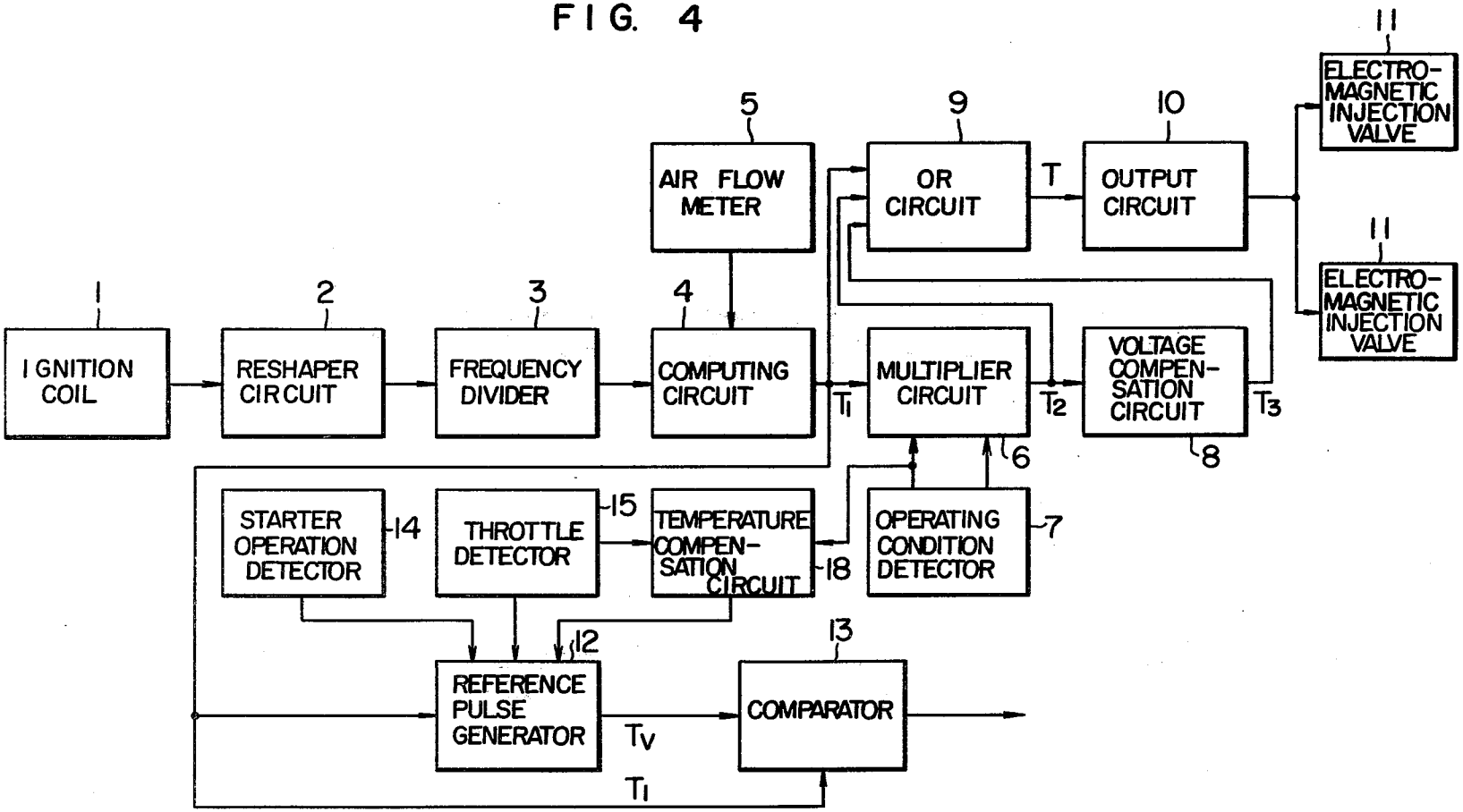
FIG. 4 is a block diagram showing the general construction of a second embodiment of the invention.
Figure 5:
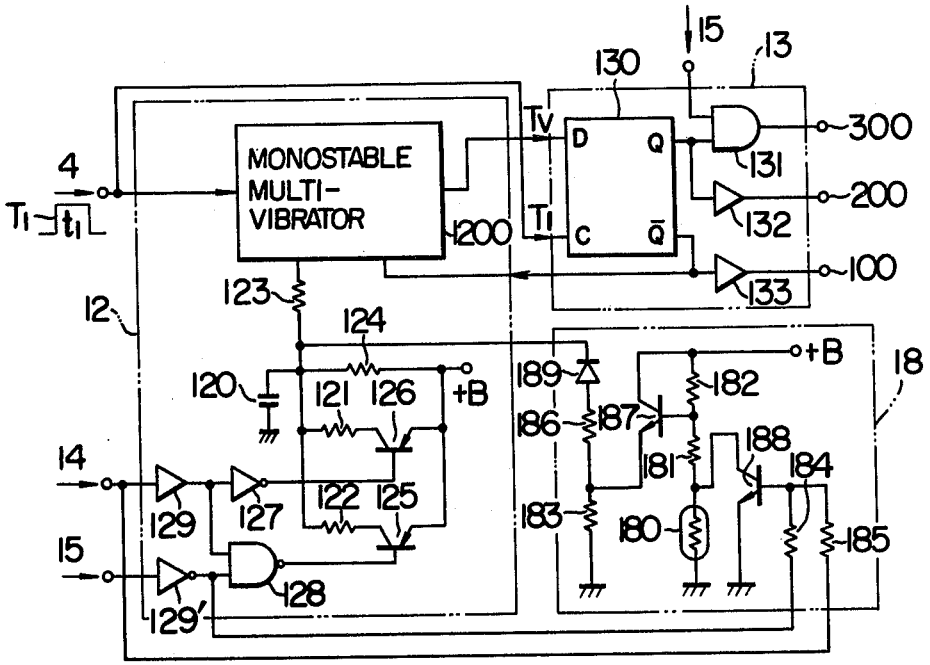
FIG. 5 is a wiring diagram showing a detailed construction of the principal parts of FIG. 4.

Next, a second embodiment of the invention will be described briefly with reference to FIG. 4 showing a block diagram of the second embodiment in which the same component parts as used in the first embodiment are designated by the same numerals. In the Figure, the starter operation detector 14 and the throttle detector 15 are connected to the reference pulse generating circuit 12, and also connected to the reference pulse generating circuit 12 is a temperature compensation circuit 18 adapted to vary the time width $t_v$ of the pulse signal $T_v$ generated from the reference pulse generating circuit 12 in accordance with the engine temperature when the opening of the throttle valve is smaller than the preset value. As shown in FIG. 5, the temperature compensation circuit 18 comprises an engine temperature detecting thermistor 180, resistors 181 to 186, transistors 187 and 188 and a diode 189. The output of the starter operation detector 14 and the output of the throttle detector 15 inverted by an inverter 129' of the reference pulse generating circuit 12, are applied to the base of the transistor 188.

With this second embodiment, during the starting period of the engine with the starter motor being in operation, in the same manner as the first embodiment, the transistors 125 and 126 are turned off, and consequently the monostable multivibrator 1200 generates a reference pulse signal $T_v$ having the time width $t_{v1}$.

Figure 6:
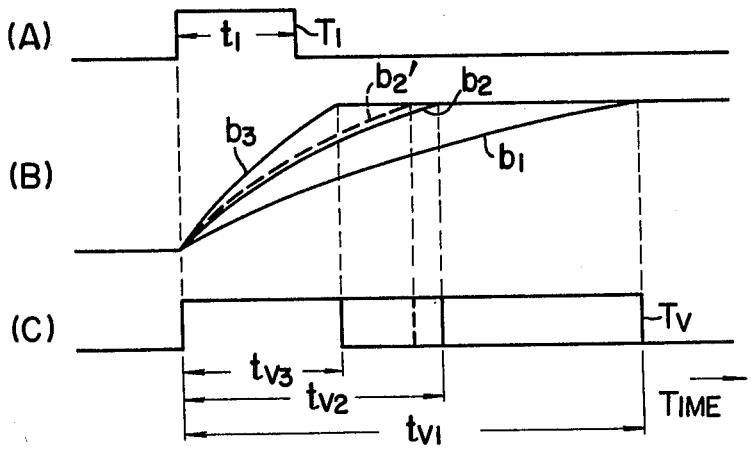
FIG. 6 is a waveform diagram showing the signal waveforms generated at various points in FIG. 5 which are useful for explaining the operation of the second embodiment.

During the normal operation after the engine has started, the starter motor is no longer in operation so that the starter operation detector 14 applies a "1" signal to the reference pulse generating circuit 12 and the transistor 126 is turned on, thus causing current flow in the resistor 121. If the throttle valve opening is smaller than the preset value at that time, the throttle detector 15 applied a "1" signal to the reference pulse generating circuit 12, so that the transistor 125 is turned off and no current flows in the resistor 122. On the other hand, during the time that the throttle valve opening is smaller than the preset value and a "0" signal is being generated from the inverter 129', the transistor 188 of the temperature compensation circuit 18 is turned off, and the base potential of the transistor 187 increases with decrease in the engine temperature by virtue of the temperature sensitive characteristic of the thermistor 180. Consequently, the emitter potential of the emitter-follower connected transistor 187 increases as the engine temperature decreases. This emitter potential is applied to the reference pulse generating circuit 12 through the resistor 186 and the diode 189. Thus, the monostable multivibrator 1200 comes into operation with the time constant determined by the capacitor 120 and the resistors 121, 123, 124 and 186, thus generating a pulse signal $T_v$ having the time width $t_{v2}$. Since the current flowing through the resistor 186 varies in accordance with the engine temperature, as shown in FIG. 6, as the engine temperature decreases, the slope of the characteristic curve $b_2$ increases to approach a characteristic curve $b'_2$, and the time width $t_{v2}$ of the pulse signal $T_v$ decreases. In this way, by virtue of the action of the temperature compensation circuit 18, the second preset rotational speed is increased as the engine temperature decreases.

On the other hand, when the starter motor is not in operation and the throttle valve opening is greater than the preset value, both of the transistors 125 and 126 are turned on, so that the monostable multivibrator 1200 comes into operation with the time constant determined by the capacitor 120 and the resistors 121, 122, 123 and 124, and the resistor 186 no longer has any bearing on the time constant. Because the transistors 187 and 188 in the temperature compensation circuit 18 are respectively off and on. At this time, as in the case of the first embodiment, the monostable multivibrator 1200 generates a pulse signal $T_v$ having the constant time width $t_{v3}$.

In other words, with the second embodiment, the time width of the reference pulse $T_v$ generated from the reference pulse generating circuit 12 in response to the input signals indicative of the throttle valve opening and the operating condition of the starter motor, becomes the time width $t_{v1}$ corresponding to the first preset rotational speed when the starter motor is in operation, becomes the time width $t_{v2}$ corresponding to the second preset rotational speed which is variable in accordance with the engine temperature when the throttle valve opening is smaller than the preset value, and becomes the time width $t_{v3}$ corresponding to the third preset rotational speed when the throttle valve opening is greater than the preset value.

In this second embodiment, the comparison circuit 13 is so designed that when the engine rotational speed is higher than the preset rotational speeds the reference pulse generating circuit 12, the D-type flip-flop circuit 130 generates "1" and "0" signals at its Q and $\overline{Q}$ outputs. As a result, a "1" signal is generated at the terminal 100 connected to the $\overline{Q}$ output through the buffer 133 when the engine rotational speed is lower than the first preset rotational speed (e.g., 400 rpm), whereas a "0" signal is generated at the terminal 100 when the engine rotational speed is higher than the first preset rotational speed. A "1" signal is generated at the terminal 300 through the AND gate 131 connected to the Q output and the throttle detector 15 only when the engine rotational speed is higher than the second preset rotational speed (e.g., 1600 rpm) and the throttle valve opening is smaller than the preset value. Also, a "1" signal is generated at the terminal 200 connected to the Q output through the buffer 132 when the engine rotational speed is higher than the third preset rotational speed (e.g., 4000 rpm), whereas a "0" signal is generated at the terminal 200 when the engine rotational speed is lower than the third preset rotational speed.

Thus, it is possible to indirectly detect the rotational speed of the engine in accordance with the level of the signal generated at the terminal 100, 200 or 300, so that as for example, the electronically-controlled fuel injection system may be caused to accomplish the required fuel enrichment for engine starting purpose in response to a "1" signal generated at the terminal 100, to similarly accomplish the desired fuel enrichment for increasing the engine power output in response to a "1" signal generated at the terminal 200, and to cut off the fuel supply for engine decelerating purpose in response to a "1" signal generated at the terminal 300. Moreover, since the second preset rotational speed is compensated in accordance with the engine temperature, particularly the second preset rotational speed is compensated to increase as the engine temperature decreases, at the so-called fast idling operation during the engine warm-up period which is designed to ensure a stable idling speed by supplying air to bypass the throttle valve of the engine, there is no danger of the rotational speed being increased and thus cutting off the fuel supply.

While, in the above-described first and second embodiments, the pulse signal $T_1$ from the computing circuit 4 is utilized as the required pulse signal related to the engine rotational speed, it is possible to utilize the output pulse signal of the frequency divider 3 whose time width is inversely proportional to the engine rotational speed, and moreover the number of preset rotational speeds used may be increased by applying to the reference pulse generating circuit 12 additional input signals indicative of other engine operating parameters than the throttle valve opening and the starter operating conditions. Further, the output level of the signals representing the results of the comparison between the preset rotational speeds and the actual engine rotational speed may be suitably changed and reversed.

We claim:

1. In combination with an electronically-controlled fuel injection system in which a pulse signal is generated for controlling the amount of fuel injection in substantial synchronism with the rotation of an engine, a rotational speed detecting apparatus comprising:

a reference pulse generator, connected to said fuel injection system, for generating a reference pulse signal in synchronism with said pulse signal, the time width of said reference pulse signal being controlled in response to an input signal applied thereto;

condition detecting means for detecting the preselected operating condition of said engine and generating an output signal indicative thereof, said output signal being applied to said reference pulse generator to control the time width of said reference pulse signal to a constant time width indicative of the predetermined rotational speed of said engine, said condition detecting means including a starter operation detector adapted to detect the operation of a starter motor and control the time width of said reference pulse signal to a first constant time width indicative of the first predetermined rotational speed; and a throttle detector adapted to detect the opening angle of a throttle valve and control the time width of said reference pulse signal to a second constant time width and a third constant time width while said throttle valve is closed and opened respectively, said second constant time width being indicative of the second predetermined rotational speed higher than said first predetermined rotational speed and said third constant time width being indicative of the third predetermined rotational speed higher than said second predetermined rotational speed, whereby whether the rotational speed of said engine is higher than said first, second and third predetermined rotational speeds or not is discriminated by said comparison circuit; and a comparison circuit, connected to said reference pulse generator and said fuel injection system, for comparing the one cycle period of said pulse signal indicative of the rotational speed of said engine with the time width of said reference pulse signal, whereby whether the rotational speed of said engine is higher than said predetermined rotational speed or not is discriminated while said engine is in said preselected operating condition.

2. A rotational speed detecting apparatus according to claim 1, wherein said comparison circuit is adapted to generate a first signal when the rotational speed of said engine is lower than said first rotational speed so that fuel enrichment is attained by said fuel injection system in response to said first signal, a second signal when the rotational speed of said engine is higher than said second rotational speed so that fuel cut-off is attained by said fuel injection system in response to said second signal, and a third signal when the rotational speed of said engine is higher than said third rotational speed so that fuel enrichment is attained by said fuel injection system in response to said third signal.

3. A rotational speed detecting apparatus according to claim 1 further comprising:

a temperature compensation circuit, connected to said reference pulse generator, for detecting the temperature of said engine and shortening said second constant time width as the temperature of said engine falls.

4. In combination with an electronically-controlled fuel injection system in which a pulse signal is generated for controlling the amount of fuel injection in substantial synchronism with the rotation of an engine, a rotational speed detecting apparatus comprising:

a reference pulse generator, connected to said fuel injection system, for generating a reference pulse signal in synchronism with said pulse signal, the time width of said reference pulse signal being controlled in response to an input signal applied thereto;

condition detecting means for detecting the preselected operating condition of said engine and generating an output signal indicative thereof, said output signal being applied to said reference pulse generator to control the time width of said reference pulse signal to a constant time width indicative of the predetermined rotational speed of said engine, said condition detecting means including a monostable multivibrator, connected to said fuel injection system, for generating a pulse signal having a constant time width in synchronism with said pulse signal generated by said fuel injection system, and a comparator, connected to said multivibrator and said fuel injection system, for comparing the time width of said pulse signal generated by said fuel injection system with the constant time width of said pulse signal generated by said multivibrator and generating an output signal indicative of the comparison result to thereby control the time width of said reference pulse signal; and a comparison circuit, connected to said reference pulse generator and said fuel injection system, for comparing the one cycle period of said pulse signal indicative of the rotational speed of said engine with the time width of said reference pulse signal, whereby whether the rotational speed of said engine is higher than said predetermined rotational speed or not is discriminated while said engine is in said preselected operating condition.

* * * * *